US005560158A

United States Patent [19]

Norton

[11] Patent Number: 5,560,158

[45] Date of Patent: Oct. 1, 1996

[54] INTEGRAL FRIEZE AND VENTED EAVE STRUCTURE

[75] Inventor: Ted Norton, Sandy, Utah

[73] Assignee: Aluma-Crown, Inc., Murray, Utah

[21] Appl. No.: 327,327

[22] Filed: Oct. 21, 1994

[51] Int. Cl.[6] ..... E04D 13/00

[52] U.S. Cl. ..... 52/95; 52/198; 52/287.1; 52/94; 454/260

[58] Field of Search ..... 52/93.2, 94, 95, 52/198, 288.1, 287.1, 199, 58, 62; 454/242, 260, 365

[56] References Cited

U.S. PATENT DOCUMENTS

| | | | |
|---|---|---|---|
| 646,236 | 3/1900 | Prutsman | 52/288.1 |
| 2,569,916 | 10/1951 | Barnes, Sr. et al. | 189/85 |
| 2,676,554 | 4/1954 | Wenger | 454/260 |
| 2,755,893 | 7/1956 | Male . | |
| 3,125,942 | 3/1964 | Smith | 454/260 |
| 3,201,910 | 8/1965 | Keesee | 52/287.1 |
| 3,373,676 | 3/1968 | Dunnington et al. . | |
| 3,777,649 | 12/1973 | Luckey . | |
| 3,824,749 | 7/1974 | Scherf . | |
| 4,189,878 | 2/1980 | Fitzgerald | 52/198 X |
| 4,195,455 | 4/1980 | Chalmers et al. . | |
| 4,461,128 | 7/1984 | Knoebl . | |
| 4,483,112 | 11/1984 | Rueblinger . | |
| 4,580,374 | 4/1986 | Quinnell | 52/95 |
| 4,658,552 | 4/1987 | Mulford . | |
| 4,709,518 | 12/1987 | Lane . | |
| 4,807,409 | 2/1989 | Sells . | |
| 4,843,783 | 7/1989 | Taravella . | |
| 4,995,308 | 2/1991 | Waggoner . | |
| 5,170,597 | 12/1992 | Stearns | 52/94 X |
| 5,195,283 | 3/1993 | Macleod et al. . | |
| 5,292,281 | 3/1994 | Butler . | |
| 5,315,799 | 5/1994 | Cullinan | 52/94 X |

FOREIGN PATENT DOCUMENTS

| | | | |
|---|---|---|---|
| 2124266 | 2/1984 | United Kingdom | 52/199 |

*Primary Examiner*—Wynn E. Wood
*Assistant Examiner*—Aimee E. McTigue
*Attorney, Agent, or Firm*—Thorpe, North & Western

[57] ABSTRACT

A one-piece crown-and-soffit member is formed from a single piece of material. The crown portion is configured for secure attachment to a building at a lower section of the crown. The soffit portion extends outward from the crown to the roof of the building for secure attachment thereto. Vent passages are formed in the soffit portion for permitting air to pass through the soffit into and out of the building.

14 Claims, 1 Drawing Sheet

INTEGRAL FRIEZE AND VENTED EAVE STRUCTURE

BACKGROUND OF THE INVENTION

1. The Field of the Invention.

The present invention relates generally to decorative siding structure for buildings, and more particularly to a one-piece integral frieze and vented soffit.

2. The Background Art.

Trim materials have found widespread acceptance in the building industry for concealing portions of buildings such as door and window casings, fascia boards, moldings, cornices and the like. For example, frieze trim has been developed for placement against upper portions of buildings such as against structure in the form of soffits and fascia panels.

Wide face channel brackets and other fasteners are often needed to assemble and interconnect the various trim elements, especially when it is desired to install frieze or crown trim, soffits and fascia panels on the same building. Each element must be installed separately. Extra time is required to ensure that the various trim elements are straight and aligned. Of current interest is a combination crown-and-soffit structure which is simple in design and easy to install accurately.

OBJECTS AND SUMMARY OF THE INVENTION

It is therefore an object of the present invention to provide decorative siding structure which is easier and less time-consuming to install accurately.

It is another object of the invention to provide such siding structure which utilizes fewer separate pieces.

The above objects and others not specifically recited are realized in a specific illustrative embodiment of a decorative siding structure for buildings. A one-piece crown-and-soffit member is formed from a single piece of material. The crown portion is configured for secure attachment to a building at a lower section of the crown. The soffit portion extends outward from the crown to the roof of the building for secure attachment thereto. Vent passages are formed in the soffit portion for permitting air to pass through the soffit into and out of the building.

Additional objects and advantages of the invention will be set forth in the description which follows, and in part will be apparent from the description, or may be learned by the practice of the invention. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
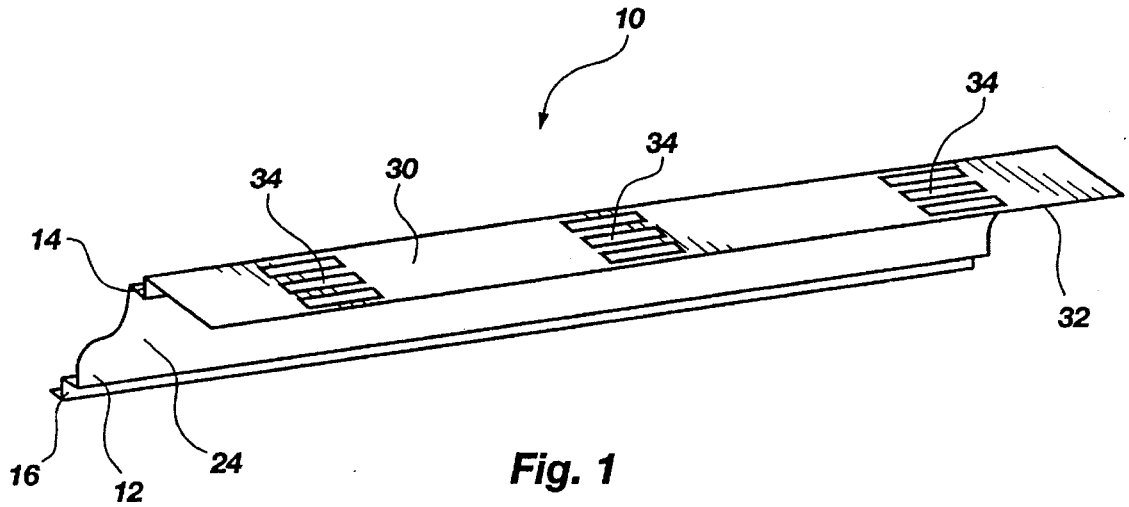
FIG. 1 is a perspective view of a crown-and-soffit structure made in accordance with the principles of the present invention.
Figure 2:
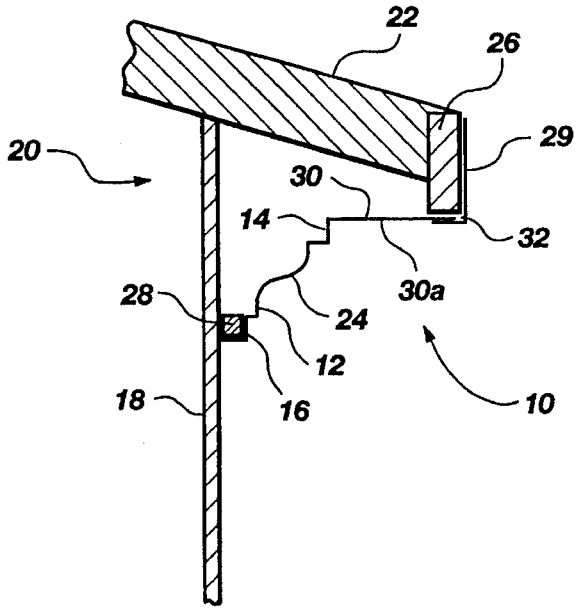
FIG. 2 is a side, cross sectional view of the crown-and-soffit structure of FIG. 1 installed on a building.

A preferred embodiment in accordance with the present invention is illustrated in FIGS. 1–2 wherein is shown a crown-and-soffit siding structure, generally designated at 10. The siding structure 10 includes an elongate continuous crown (or frieze) 12 having upper and lower sections 14 and 16, respectively. The lower section 16 is configured for secure attachment to the sidewall 18 of a building 20. Each of the upper and lower sections 14 and 16 preferably comprise an elongate right-angle channel as shown in FIGS. 1–2. The crown 12 is preferably formed from a thin sheet of metal to include a curved central/intermediate section 24 bounded by the upper and lower right-angle channel sections 14 and 16, respectively, such that a cross section of the curved central section 24 at any point thereof comprises a curvilinear line. As such, the crown 12 is configured and dimensioned to extend upwardly and forwardly from its point of attachment to the side 18 of the building 20 in a direction away from the building to thereby conceal a portion of the side.

An elongate continuous soffit panel 30 is connected along its length along the upper section 14 of the crown 12. The soffit panel 30 preferably has a substantially planer exterior surface 30*a* (FIG. 2) so as to extend horizontally outward from the upper section 14 of the crown 12 in a direction away from the building 20. The exterior surface 30*a* is thus preferably common to a horizontal plane. The crown 12 and soffit panel 30 collectively form a one-piece unitary member, and are preferably shaped from the same piece of material.

The soffit panel 30 is configured for attachment at its distal edge 32 to a portion of a roof 22 of the building 20 which extends outwardly from the sidewall 18 as shown, such as fascia board 26. The crown 12 is configured for attachment to the wall 18. Most preferably, the lower section 16 of the crown 12 is secured to the wall 18 by attachment to a nailing block 28, and the soffit panel 30 is secured to the fascia board 26 with a fascia panel 29 as shown in FIG. 2. The crown 12 may of course be secured to the wall 18 in any suitable manner, such as with nails or an industrial adhesive instead of with the nailing block 28.

The soffit panel 30 includes vent passages 34 (FIG. 1) formed therein for permitting air to pass through the soffit panel into and out of the building 20. The vent passages 34 may of course embody many different designs. It is to be understood that the phrase "vent passage" as used herein shall refer broadly to either a single opening or an array of openings or to any suitable venting concept. For example, each vent passage 34 comprises an array of individual openings, but may alternatively comprise a single slit. The vents may thus comprise a series of spaced-apart vent passages 34 formed in the soffit panel 30 including two opposing end vents and at least one interior vent as shown. Each interior vent would then have two adjacent spaced-apart vent passages 34 on either side. The vent passages 34 may be replaced with a single elongate vent passage formed in the soffit panel 30 which extends along at least part of the length of the soffit panel. Vent passages 34 may also be formed anywhere in the crown 12, such as in the curved central section 24 or in the right-angle channel sections 14 and 16.

The crown-and-soffit siding structure 10 is preferably shaped from a single piece of sheet metal. It will be appreciated that the one-piece unitary nature of the crown-and-soffit siding structure 10 makes it easier to align and install properly and therefore results in lower installation costs without eliminating the vents 34. Only the single structural piece 10 need be installed (the fascia panel 29 is of course optional). There are fewer parts involved and thus less time required for installation. Laborers must make markings such as chalk lines for each structural item to be fastened to a building to prevent a crooked or otherwise misaligned installation. Since the crown-and-soffit siding structure 10 is a single piece, only one chalk line is necessary to install it.

It will be appreciated that the present invention can be formed entirely by shaping and cutting a piece of the sheet metal. Of course, the invention could also be made by securing together separate pieces of metal or other suitable material. A preferred method of manufacturing the crown-and-soffit siding structure 10 includes the following steps:

(a) selecting a single sheet of flexible metal;

(b) selectively bending a first section of the sheet to form therefrom an elongate crown means having opposing upper and lower sections and being configured for secure attachment at its lower section to a point of attachment on a building so as to extend outwardly from the building;

(c) selectively bending a second section of the sheet to form therefrom an elongate soffit means connected along its length along the upper section of the crown means so as to extend outwardly from the crown means in a direction away from the building, wherein the crown means and the soffit means collectively form a one-piece unitary member from the metal sheet;

(d) forming venting means in the soffit means for permitting passage of air through the soffit means.

A preferred method of concealing part of a building and ventilating the building, in accordance with the present invention, includes the following steps:

(a) selecting an elongate continuous crown member having upper and lower sections;

(b) affixing the crown member at its lower section to a point of attachment on the building so that the crown member extends upwardly and forwardly from the point of attachment in a direction away from the building to thereby conceal a portion of a side of the building, wherein said crown member is part of a crown-and-soffit means including a one-piece unitary elongate soffit member connected along its length along the upper section of the crown member so as to extend outwardly from the crown member in a direction away from the building and toward a portion of the roof of the building, wherein the crown member and the soffit member collectively form a one-piece unitary member, said soffit member including venting means formed therein for permitting passage of air through the soffit member; and (c) affixing the soffit member to a point of attachment on the roof of the building to thereby enable passage of air into and out of the building through the venting means formed in the soffit member.

It will be appreciated that various modifications and alternative configurations of the exemplary siding structure 10 can be made in accordance with the principles of the present invention. Such changes may from time to time be made by those skilled in the relevant arts without departing from the spirit and scope of the invention as defined by the appended claims. Those skilled in the art will appreciate that the scope of the present invention encompasses many combinations and a broad spectrum of features and structures equivalent to those specifically discussed herein. The principles of the invention may thus be used in any setting requiring the advantages thereof. Those having ordinary skill in the field of this invention will appreciate the advantages of the invention and its application to a wide variety of uses, and that objectives stated above are advantageously achieved by the present invention.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A decorative siding structure for buildings having sidewalls, said siding structure comprising:

elongate crown means having opposing upper and lower side sections and an intermediate section between said side sections, said crown means being configured for secure attachment at the lower section to a point of attachment on a sidewall of the building so as to extend upwardly and outwardly from the sidewall ; and elongate continuous soffit means integrally connected along its length to the upper side section of the crown means so as to extend outwardly from the crown means in a direction away from the sidewall of the building, wherein the crown means and the soffit means collectively form a one-piece unitary member, said soffit means being configured for attachment to a roof portion of the building which extends outwardly from the sidewall; and venting means formed anywhere in the one-piece unitary member for permitting passage of air therethrough.

2. A decorative siding structure as defined in claim 1, wherein the soffit means comprises a single soffit panel having a substantially planer exterior surface, wherein the crown means is configured and dimensioned to extend upwardly and forwardly from the point of attachment on the sidewall in a direction away from the building to thereby conceal a portion of a side of the building, such that the soffit panel extends substantially horizontally outward from the upper section of the crown means to thereby cause the exterior surface of the soffit panel to reside substantially common to a horizontal plane.

3. A decorative siding structure as defined in claim 1, wherein the venting means comprises a series of spaced-apart vent passages formed in the soffit means including two opposing end vent passages and at least one interior vent passage, such that each interior vent passage has two adjacent spaced-apart vent passages on either side.

4. A decorative siding structure as defined in claim 3, wherein each vent passage comprises an array of openings formed in the soffit means.

5. A decorative siding structure as defined in claim 1, wherein the venting means comprises a single elongate vent passage formed in the soffit means and extending along at least part of the length of the soffit means, said vent passage comprising an array of openings formed in the soffit means.

6. A decorative siding structure as defined in claim 1, wherein each of the upper and lower sections of the crown means comprises a planer side wall which is bent to form an elongate right-angle channel member, such that the upper and lower sections respectively comprise upper and lower elongate right-angle channel members.

7. A decorative siding structure as defined in claim 6, wherein the crown means further comprises a thin wall formed into a curved central section bounded by the upper and lower right-angle channel members, such that a cross section of the curved central section at any point thereof comprises a curvilinear line.

8. A decorative siding structure for buildings having sidewalls, said siding structure comprising:

elongate continuous crown means having opposing upper and lower side sections and an intermediate section between said side sections, said crown means being configured for secure attachment at its lower section to a point of attachment on a sidewall of the building, wherein the crown means is configured and dimensioned to extend upwardly and forwardly from the sidewall in a direction away from the building to thereby conceal a portion of a side of the building, wherein each of the upper and lower sections of the crown means comprises a planer side wall which is bent to form an elongate right-angle channel member, such that the upper and lower sections respectively comprise upper and lower elongate right-angle channel members, said crown means further comprising a thin wall formed into a central section bounded by the upper and lower right-angle channel members;

an elongate continuous soffit panel having a substantially planer exterior surface integrally connected along its length to the upper section of the crown means so as to extend substantially horizontally outward from the upper section of the crown means in a direction away from the sidewall of the building with the exterior surface of the soffit panel being substantially common to a horizontal plane, wherein the crown means and the soffit means collectively form a one-piece unitary member;

said soffit panel being configured for attachment to a roof portion of the building which extends outwardly from the sidewall, said soffit panel including venting means formed therein for permitting passage of air through the soffit panel into and out of the building.

9. A decorative siding structure as defined in claim 8, wherein the venting means comprises a series of spaced-apart vent passages formed in the soffit panel including two opposing end vent passages and at least one interior vent passage, such that each interior vent passage has two adjacent spaced-apart vent passages on either side.

10. A decorative siding structure as defined in claim 9, wherein each vent passage comprises an array of openings formed in the soffit panel.

11. A decorative siding structure as defined in claim 8, wherein the venting means comprises a single elongate vent passage formed in the soffit panel and extending along at least part of the length of the soffit panel, said vent passage comprising an array of openings formed in the soffit panel.

12. A decorative siding structure as defined in claim 8, wherein the, central section of the crown means comprises a curved wall such that a cross section at any point thereof comprises a curvilinear line.

13. A method of concealing part of a building having sidewalls and ventilating the building, said method comprising the steps of:

(a) selecting an elongate continuous crown member having upper and lower side sections and an intermediate section between said side sections;

(b) affixing the crown member at its lower section to a point of attachment on a sidewall of the building so that the crown member extends upwardly and forwardly from the point of attachment in a direction away from the sidewall of the building to thereby conceal a portion of a side of the building, wherein said crown member is part of a crown-and-soffit means including an elongate continuous soffit member integrally connected along its length to the upper side section of the crown member so as to extend outwardly from the crown member in a direction away from the sidewall of the building and toward a portion of the roof of the building, wherein the crown member and the soffit member collectively form a one-piece unitary member, said soffit member including venting means formed therein for permitting passage of air through the soffit member; and (c) affixing the soffit member to a point of attachment on the roof of the building.

14. A method of manufacturing a decorative siding structure for buildings having sidewalls, said method comprising the steps of:

(a) selecting a single sheet of flexible metal;

(b) selectively bending a first section of the sheet to form therefrom an elongate continuous crown means having opposing upper and lower side sections and an intermediate central section between said side sections, said crown means being configured for secure attachment at its lower section to a point of attachment on a sidewall of the building so as to extend outwardly from the building;

(c) selectively bending a second section of the sheet to form therefrom an elongate continuous soffit means integrally connected along its length to the upper section of the crown means so as to extend outwardly from the crown means in a direction away from the sidewall of the building when the lower section of the crown means is attached to the sidewall, wherein the crown means and the soffit means collectively form a one-piece unitary member from the metal sheet;

(d) forming venting means in the soffit means for permitting passage of air through the soffit means.

* * * * *